United States Patent [19]

DeSantis

[11] Patent Number: 4,540,092

[45] Date of Patent: Sep. 10, 1985

[54] SECURITY DISPLAY RACK

[76] Inventor: John DeSantis, 115 Overlook Ave., Staten Island, N.Y. 10304

[21] Appl. No.: 603,493

[22] Filed: Apr. 24, 1984

[51] Int. Cl.[3] ..... E05B 73/00

[52] U.S. Cl. ..... 211/4; 70/59; 70/62

[58] Field of Search ..... 211/4, 7, 8, 190, 207, 211/208; 70/58, 59, 60, 62

[56] References Cited

U.S. PATENT DOCUMENTS

| | | | |
|---|---|---|---|
| 3,378,144 | 4/1968 | Webster | 211/4 |
| 3,400,812 | 9/1968 | Snow | 211/4 X |
| 3,690,130 | 9/1972 | Eutzler | 70/59 X |
| 4,069,691 | 1/1978 | Simpson | 70/59 |
| 4,069,919 | 1/1978 | Fernbaugh | 70/62 X |
| 4,204,601 | 5/1980 | Thomas | 211/4 |
| 4,253,578 | 3/1981 | Rekow | 211/204 X |
| 4,260,063 | 4/1981 | Bennett et al. | 70/59 X |

FOREIGN PATENT DOCUMENTS

| | | | |
|---|---|---|---|
| 0046403 | 2/1982 | European Pat. Off. | 70/59 |

*Primary Examiner*—Robert W. Gibson, Jr.

*Attorney, Agent, or Firm*—Curtis, Morris & Safford

[57] ABSTRACT

A rack for securely displaying clothes while permitting the clothing to be tried on by a consumer is disclosed which includes a support stand and a hanger support bar mounted on the stand. The hanger support bar is hollow and has an elongated slot formed therein with a plurality of apertures along its length joined with the slot. Individual elongated flexible guard members having enlarged head portions at one end fit in any one of the apertures while preventing withdrawal through the slot. The guard members pass through a portion of a garment passed on a conventional hanger. Removal of the guards from the hanger support bar is prevented by a blocking device which can be moved between first and second positions to block the apertures. The end of the guard members which pass through the clothing are secured to a blocking device on the base of the display stand for preventing removal of a garment therefrom.

9 Claims, 9 Drawing Figures

FIG. 6
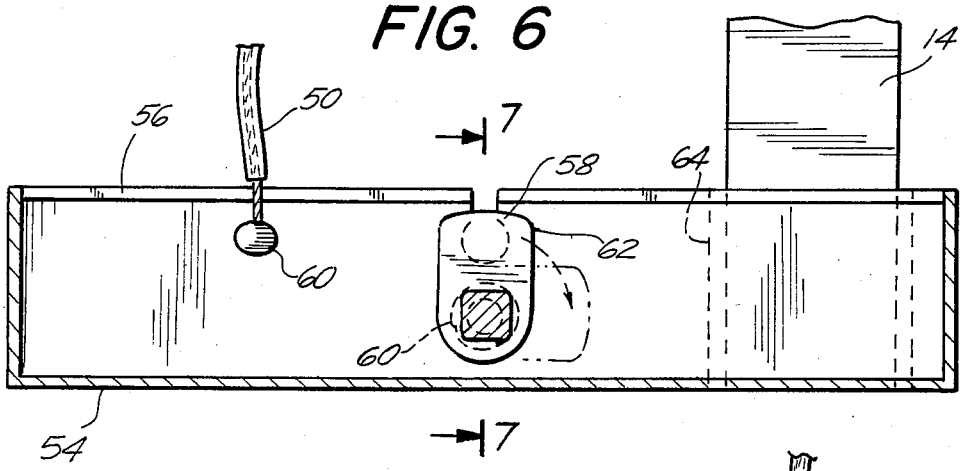
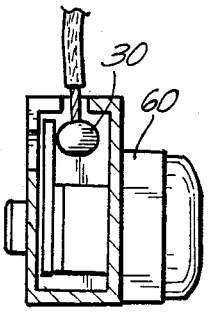
FIG. 7
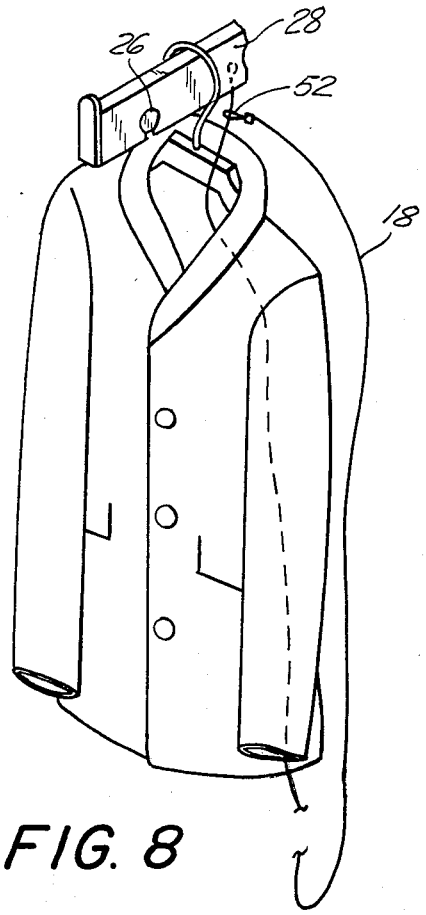
FIG. 8
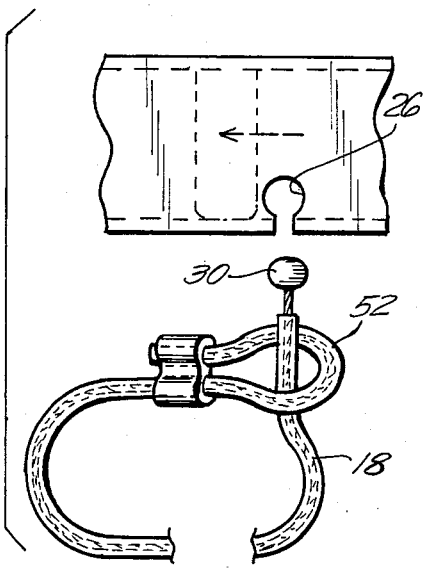
FIG. 9

SECURITY DISPLAY RACK

BACKGROUND OF THE INVENTION

1. Field of the Invention

The present invention relates to garment display racks and, more particularly, to a security garment display rack for securing garments to the rack while permitting them to be displayed on conventional hangers which allow them to be removed and tried on at the rack.

2. Description of the Prior Art

In retail stores, it is quite conventional for garments and other products to be displayed on hangers on support racks so that they are readily viewed by the consumer, removed and tried on. However, theft of such merchandise, particularly expensive garments, from such display racks has become a serious problem. This is true not only in retail stores but even in cloakrooms and restaurants.

In order to overcome the problem of theft, a variety of different types of security devices have previously been proposed for clothing and other articles. These devices have not generally met with widespread acceptance for a number of reasons. In particular, they are, by and large, quite complex and expensive to manufacture. In many cases, the devices require special hanger constructions, such as are known, for example, in U.S. Pat. Nos. 4,260,063 and 3,647,072. In others, where conventional hangers may be used, the devices are still relatively complex in that the guard members or cables use to secure the garment to the rack are individually mounted and cannot move with respect to the rack. Such devices are shown, for example, in U.S. Pat. Nos. 4,069,919; 3,985,183; and 3,567,034. As a result, there is only limited freedom of movement by the user in removing the garment for the purpose of trying it on.

SUMMARY OF THE INVENTION

It is an object of the present invention to provide a security display rack which permits garments to be displayed in public on conventional clothes hangers while preventing their removal away from the rack.

Another object of the present invention is to provide a security display rack which is relatively simple in construction and which will permit a degree of freedom of movement of the garment and the hanger along the rack.

Yet another object of the present invention is to provide a garment rack which will utilize conventional hangers while keeping the garment securely attached to the rack yet permitting the garment to be tried on.

A further object of the present invention is to provide a security display rack which is relatively simple in construction and inexpensive to manufacture.

A still further object of the present invention is to provide a security display rack which is relatively easy to operate, permitting the garments to be placed on the rack at substantially any point.

In accordance with an aspect of the present invention, a security display rack is provided for securely displaying clothing on conventional hangers. The rack includes a support stand which may be vertically adjustable in height and a hanger support bar mounted on the stand. The hanger support bar is hollow and has an elongated slot formed therein, preferably along its lower surface, and a plurality of apertures formed therein along its side surface but joined to the slot. A plurality of individual elongated, flexible guard members each having a first end portion including an enlarged head portion dimensioned to fit in any one of the apertures is provided to secure the garment to the rack. The guard member is inserted through the sleeve or the like of a garment and the head portion thereof is placed in the aperture of the hanger support bar. In this way, the guard members' head portions are contained within the bar against removal through the slot while the guard member itself can slide in the slot along the entire length of the hanger support bar.

The guard members are locked in the hanger support bar by an elongated locking bar that is slidably mounted in the hanger support bar and has a plurality of blocking tabs positioned to block the apertures in a first position of the locking bar to prevent removal of the guard members from the hanger bar through the apertures. The blocking bar is biased to a second unblocking position at which the guard members can be removed through the apertures for releasing the clothing from the guard member. Means are provided for locking the bar in its first blocking position to lock the guard members in the hanger bar.

The guard members have second opposite end portions which include means for removing the garment from the guard member when the first end portion of heads of the guard members are locked in the hanger support bar.

The above, and other objects, features and advantages of this invention will be apparent in the following detailed description of an illustrative embodiment of the invention read in connection with the accompanying drawings wherein:

BRIEF DESCRIPTION OF THE DRAWINGS

FIG. 6 is a side sectional view taken along line 6—6 of FIG. 2, showing the lower lock member for the flexible guard members;

FIG. 7 is a sectional view taken along lines 7—7 of FIG. 6;

FIG. 8 is a perspective view showing another form of the guard member of the invention; and FIG. 9 is an enlarged view of the ends of the guard member shown in FIG. 8.

DESCRIPTION OF THE PREFERRED EMBODIMENT

Figure 1:
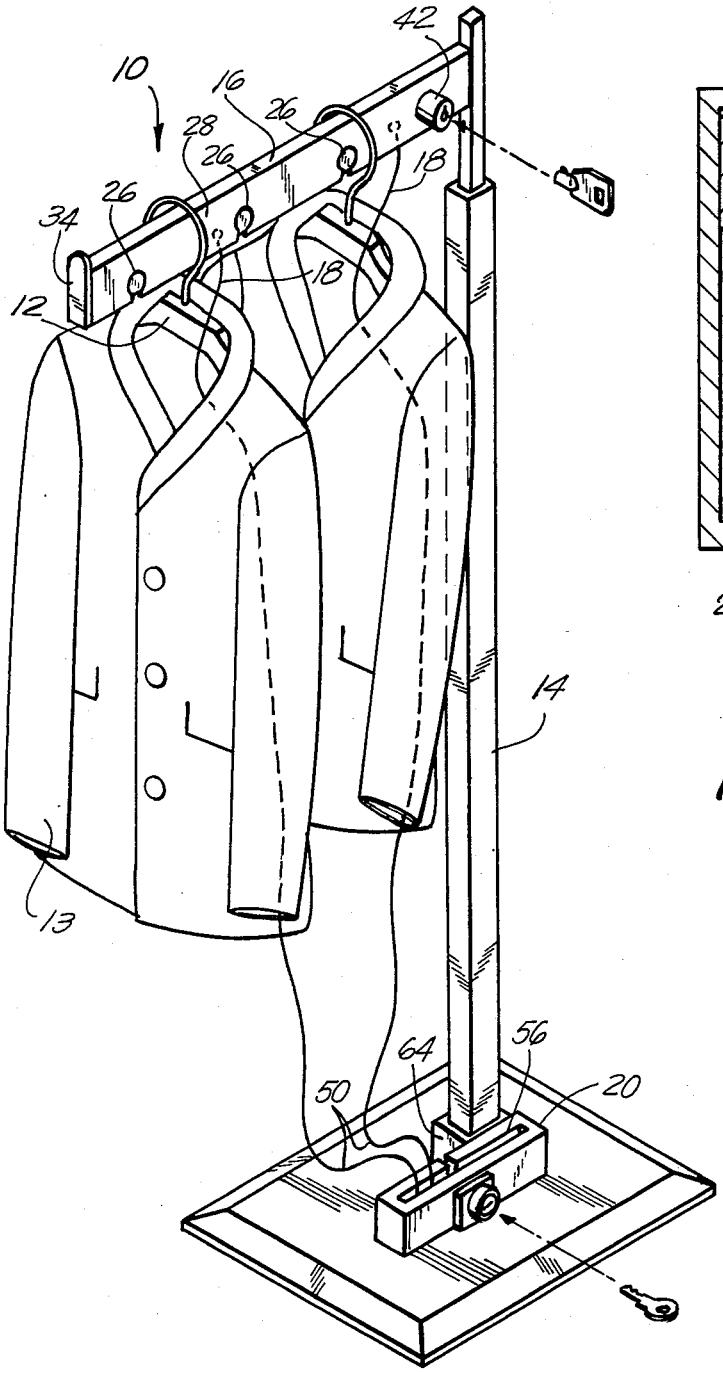
FIG. 1 is a perspective view of a security display rack constructed in accordance with the present invention, showing garments securely mounted thereon.
Figure 4:
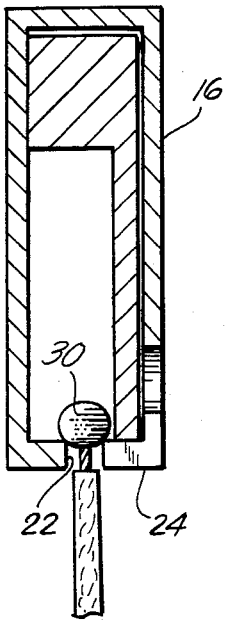
FIG. 4 is a sectional view taken along line 4—4 of FIG. 2.
Figure 2:
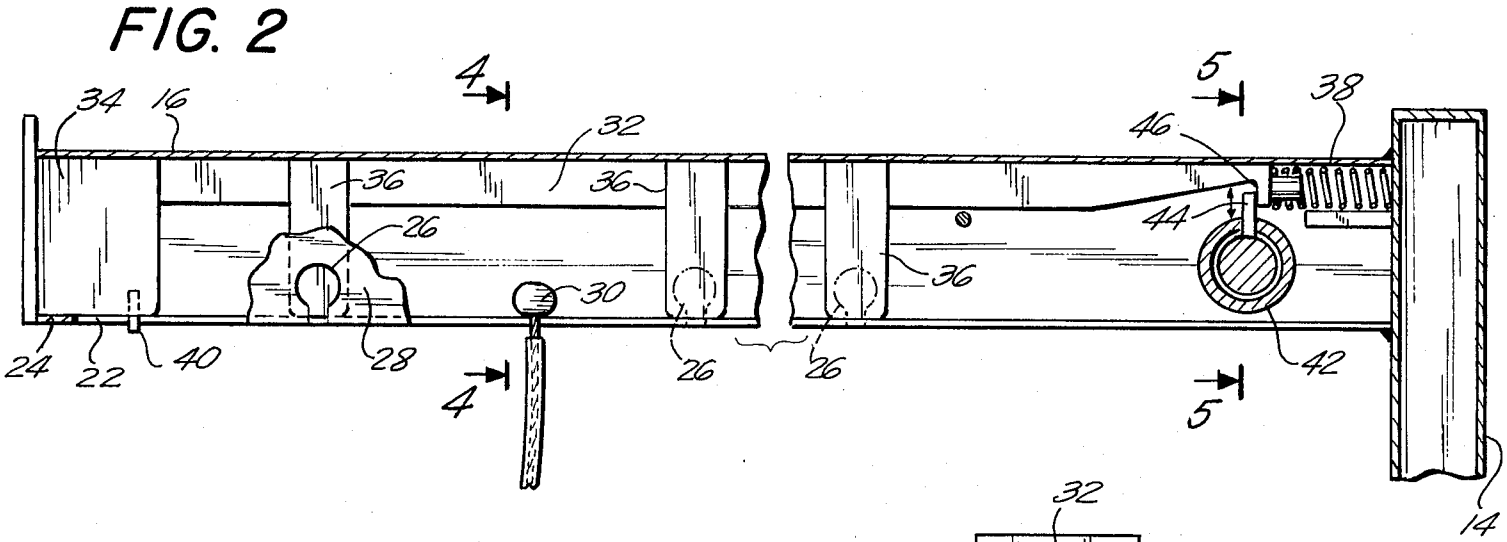
FIG. 2 is a side sectional view taken along line 2—2 of the hanger support bar of the display rack of the invention showing the rack in the locked position.
Figure 5:
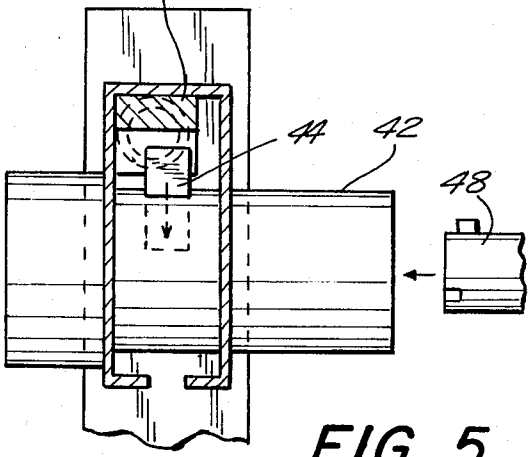
FIG. 5 is a sectional view taken along line 5—5 of FIG. 2.

Referring now to the drawings in detail, and initially, to FIG. 1 thereof, it will be seen that a display rack 10 constructed in accordance with the present invention is illustrated. The display rack is adapted to support on conventional hangers 12, garments 13, such as jackets, coats and the like. It includes a vertical support stand 14 and a horizontal hanger support bar 16. The vertical support stand 14 can be of any convenient desired and known construction. One suitable form of adjustable vertical support stand is disclosed, for example, in applicant's own prior U.S. Pat. No. 4,239,169.

Support bar 16 is adapted to lock one end of a plurality of flexible guard members 18 to the support bar and thereby selectively prevent removal thereof. These flexible guard members, which may be chains or cables, are passed through the sleeve of the garment and their opposite end is secured, as described hereinafter, in the security bar 20 which, in the illustrative embodiment of the invention, is mounted on support stand 14. The hanger or support bar 16 permits cables 18 to slide along the length of the bar without being removed. Thus, the hanger on which the garment is supported also can be moved along the length of the bar and the garment can be conveniently removed from the hanger and tried on, without being separated from the flexible guard member. This arrangement permits conventional hangers to be used and even conventional vertical support stands.

Referring to FIGS. 2–5, it is seen that the hanger support bar 16 is, in this preferred embodiment, generally rectangular in cross-section and elongated in length. It has an elongated slot 22 formed in its lower surface 24 and a plurality of keyhole shaped openings 26 formed in its side surface 28 joined to the slot.

The upper ends of the guard members 18 have metal beads or the like 30 firmly secured thereto which are generally complementary to and fit in the keyhole shaped openings 26 in the hanger support bar. In this way, the upper ends of the guard members are placed in the hollow hanger support bar 16 and the flexible guard members themselves extend down through the slot 22 of the bar. Slot 22 remains open at all times to permit the flexible guard members to slide from one end to the other thereof but the heads of the flexible guard members are dimensioned such that they cannot be removed through the slot. They can only be removed through apertures 26.

In order to lock the guard members in hanger support bar 16, an elongated blocking bar 32 is provided. As seen in FIGS. 2–5, blocking bar 32 has an end portion 34 which closes the open end of the hanger support bar 16. The slot 22 does not extend to the end of bar 16 (see FIG. 2) and thus, prevents removal of the guard members through that end of the bar. The opposite end of the bar is, of course, welded or otherwise securely attached to the vertical support 14 so that the guard members cannot be removed through that end.

The elongated blocking bar 32 includes a plurality of tab members 36 positioned to selectively and simultaneously block apertures 26 in hanger bar 16.

Figure 3:
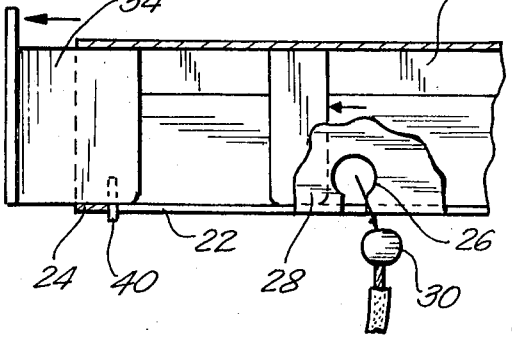
FIG. 3 is a partial side sectional view similar to FIG. 2 showing the rack in the unlocked position.

The elongated blocking bar 32 is slidably mounted in hanger support bar 16 and is biased to a normal unblocking positioned by a spring 38. The limit of movement of the blocking bar to its aperture unblocking position, seen in FIG. 3, is defined by a stop member or pin 40 on the end member 34 of blocking bar 32 which engages the end of the slot 22 in bar 16.

A lock 42 is provided in hanger support bar 16 which is of conventional construction and includes a locking tab 44. The tab 44 is positioned so that, in the locked position of the lock, it will engage a cooperating tab 46 formed in blocking bar 32 to hold that bar in its locked position (FIG. 2) after the bar has been manually pushed toward its locked position and the lock operated by key 48. In that position, the cooperation of lock tab 44 and tab 46 on blocking bar 36 holds the blocking bar against the bias of spring 38. When the lock is opened by the insertion and turning of key 48, in the usual manner, blocking bar 32 is released and automatically moves to its unblocking position (FIG. 3) under the influence of the spring.

By this arrangement, a relatively simple mechanism is provided to simultaneously block all of the apertures 26 in the hanger bar 16 while permitting guard members 18 to slide freely throughout the length of hanger bar 16. In addition, when it is desired to remove a particular garment, the blocking bar is easily unlocked, and the guard member 18 associated with the garment to be removed can be rapidly removed from the hanger bar at the aperture nearest to it. There is no need to move all of the garments to a single aperture, as is required in some previously proposed arrangements.

In order to prevent removal of the garment from the guard member when the hanger support bar is locked, the opposite ends 50 of the guard members can be secured, either in the security bar 20, as described hereinafter, or they can be provided with a loop 52 formed thereon, as shown in FIGS. 8 and 9. This loop is first passed through the sleeve of a garment and then, the upper end 30 of the guard member is passed through the loop before it is positioned within hanger bar 16 and locked in place. Of course, with this arrangement, the guard member must be quite long, to permit freedom of removal of the garment from the hanger for purposes of trying it on. However, this arrangement requires less hardware and locks than the security bar arrangement shown in FIGS. 2 and 6.

The security bar 20 includes a generally rectangular hollow bar 34, similar in construction to hanger bar 16. In this case, a slot 56 is provided in the upper surface of the generally rectangular bar whose ends are closed by welded end plates or the like at the ends of the bar. A single keyhole aperture 58 is provided in the security bar joining the slot for the purpose of receiving an enlarged head 60 at the end 50 of each of the guard members 18. In this case, each of the guard members enter the security bar through the single aperture since, even when the garment is to be removed from the guard member for sale, it is only necessary to remove the upper end of the guard member from the hanger support bar 16 in order to remove the guard member from the garment. By this arrangement, the guard members can all slide in the slot of the security bar to aid in freedom of movement of the garment.

Removal of the guard 18 members from the security bar is achieved by the provision of a lock 60 having a tab 62 thereon which is positioned to block the aperture 58 in the security bar when the lock is in its locked position, as shown by the solid and dotted lines in FIG. 6.

Security bar 20 can be mounted in a permanent fixed position at any location desired. For example, it can be bolted to the floor or a wall or otherwise. In the preferred illustrative embodiment of the invention, the security bar is provided with a welded on sleeve 64 that is adapted to slide on the vertical support 14 of stand 10. By this arrangement, an integral unitary display stand is provided and the security bar cannot be removed from the stand.

Accordingly, it will be seen that a relatively simply constructed security display stand has been provided which is easy to operate and economical to construct. The arrangement permits the use of conventional hangers and avoids the expense of specially constructed hangers. Moreover, it has the flexibility to permit the garments displayed to be moved from one position to another along the display stand. And, it permits the display stand itself to be moved from place to place.

Although an illustrative embodiment of the present invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. A display rack for securely displaying clothing while permitting the clothing to be tried on by a consumer, said rack comprising, a support stand and a hanger support bar mounted on said stand, said hanger support bar being hollow and having an elongated slot formed herein and a plurality of apertures along its length joined with said slot, a plurality of individual elongated flexible guard members having at least one enlarged head portion at one end thereof dimensioned to fit in any one of said apertures while preventing withdrawl through said slot, said guard member being adapted to pass through a portion of a garment placed on a conventional hanger supported on said hanger support bar, means movably mounted in said hanger support bar for movement between first and second positions blocking and unblocking said apertures thereby to prevent removal of said guard members from the hanger support bar in said first position, means for locking said movably mounted means in the first position thereof; and means for cooperating with the other end of said guard members for selectively preventing removal of a garment in which the guard member is secured; said other end of said guard members having enlarged head portions and said cooperating means comprising a hollow security bar mounted on said support stand having an elongated slot and at least one aperture therein joined with a slot for receiving the enlarged head portions of the other ends of the guard members, and means for selectively blocking and unblocking said aperture in the security bar to control removal of garments from the guard members.

2. A display rack as defined in claim 1 wherein said movably mounted means in said hanger bar is an elongated bar having a plurality of tops respectively associated with said apertures.

3. A display rack as defined in claim 2 including means for biasing said elongated bar to its second, unblocking position, said locking means holding the elongated bar in its first locking position against the bias of said biasing means.

4. A display rack as defined in claim 3 wherein said biasing means is a spring.

5. A display rack as defined in claim 1 wherein said support stand is vertically adjustable.

6. A display rack as defined in claim 1 wherein said cooperating means comprises a loop formed in said other end of the guard members adapted to receive said one end before insertion of the head portions thereof in the apertures of the hanger bar.

7. A display rack for securely displaying clothing on conventional hangers while permitting the clothing to be tried on by the consumer, said rack comprising, a support stand and a hanger support bar mounted on said stand, said hanger support bar being hollow and having an elongated slot formed therein and plurality of apertures along its length joined with said slot, a plurality of individual elongated flexible guard members having a first end portion including an enlarged head portion dimensioned to fit in any one of said apertures while being retained in the support bar above said slot as the guard members extend through the slot and are permitted to slide therealong; said guard members being adapted to pass through a portion of a garment placed on a hanger on the hanger support bar, an elongated locking bar slidably mounted in said support bar and having a plurality of blocking tabs positioned to block said apertures in a first position of the locking bar to prevent removal of said guard members from the hanger bar to a second unblocking position, means for locking said blocking bar in said first blocking position thereof to lock said guard members in said hanger bar, said guard members having second opposed end portions including means for preventing removal of a garment from the guard member; said preventing means includes enlarged head portions on the other end of said guard members and a security bar having an elongated slot and at least one aperture therein joined with the slot for receiving the enlarged heads at the other ends of the guard members and means for selectively blocking and unblocking said aperture in the security bar to control removal of garments from the guard members.

8. A display rack as defined in claim 7 wherein said security bar includes means for mounting the security bar against removal on said support bar.

9. A display rack as defined in claim 8 wherein said support stand is vertically adjustable.

* * * * *